US005579836A

United States Patent [19]

Maruyama

[11] Patent Number: 5,579,836

[45] Date of Patent: Dec. 3, 1996

[54] HEAT-EXCHANGER COIL ASSEMBLY AND COMPLEX THEREOF

[76] Inventor: Noboru Maruyama, 2-26-14 Shirasagi, Nakano-ku, Tokyo, Japan

[21] Appl. No.: 511,589

[22] Filed: Aug. 4, 1995

[30] Foreign Application Priority Data

Aug. 11, 1994 [JP] Japan ..... 6-209402

[51] Int. Cl.[6] ..... F28D 1/04

[52] U.S. Cl. ..... 165/175; 165/163; 165/DIG. 471

[58] Field of Search ..... 165/132, 163, 165/173, 175

[56] References Cited

U.S. PATENT DOCUMENTS

| | | | |
|---|---|---|---|
| 2,378,308 | 6/1945 | Livingood | 122/250 R |
| 3,653,796 | 4/1972 | Kercher et al. | 431/328 |
| 4,143,816 | 3/1979 | Skadeland | 237/8 R |
| 4,265,094 | 5/1981 | Haasis, Jr. | 62/238.6 |
| 4,346,759 | 8/1982 | Cohen et al. | 165/163 |
| 4,488,594 | 12/1984 | Ying | 165/163 |
| 4,671,343 | 6/1987 | Fukumoto | 165/162 |
| 4,893,672 | 1/1990 | Bader | 165/163 |
| 4,909,318 | 3/1990 | Ymse | 165/145 |
| 5,325,684 | 7/1994 | Stierlin et al. | 62/487 |
| 5,419,392 | 5/1995 | Maruyama | 165/163 |

FOREIGN PATENT DOCUMENTS 2476804 8/1981 France .

*Primary Examiner*—Allen J. Flanigan
*Attorney, Agent, or Firm*—Kuffner & Associates

[57] ABSTRACT

A plurality of each of said heat-exchanger coils each having a different winding diameter are provided between a header in the inlet side provided in an inlet tube and a header in the outlet side provided in the outlet tube so that the two headers are communicated to each other, and also a group of heat-exchanger coils each surrounded by another heat-exchanger coil having a larger diameter as compared to that of the former is provided.

3 Claims, 13 Drawing Sheets

HEAT-EXCHANGER COIL ASSEMBLY AND COMPLEX THEREOF

BACKGROUND OF THE INVENTION

The present invention relates to a heat-exchanger coil assembly. More particularly, the invention relates to a coil assembly for efficiently exchanging heat between a heat-exchange medium accommodated in the body of a heat exchanger and a heat exchange medium flowing through the coil.

Generally, a heat exchanger is based on a pipe system or a plate system The heat exchanger based on the pipe system is used when pressure resistance is required. There are various types of heat exchangers based on the pipe system, such as those based on a coil system or a multiple tube system. Of these, a heat exchanger based on a coil system is widely used for various purposes because the construction is simple, but because the heat transfer area is smaller as compared to the tank (body) capacity, it is used as a heat exchanger in circumstances requiring a relatively small capacity.

FIG. 16 shows a conventional type of heat exchanger based on the coil system. A heat-exchanger coil 101 wound in a spiral form is provided in a body section 104, and an inlet pipe 102 and an outlet pipe 103 are provided at both edges of the coil 101. A heat-exchange medium such as a liquid or a gas is introduced through the inlet pipe 102 passes through the heat-exchanger coil 101, and is discharged through the outlet pipe 103 from the body section 104. Mainly while flowing through the coil 101, heat exchange is executed through the coil wall between the heat-exchange medium in the coil 101 and that in the body section 104.

In order to increase the quantity of exchanged heat and enhance the heat-exchanging capability in the heat exchanger based on the coil system as described above, it is necessary to make the heat transfer area larger by increasing the number of turns in the coil 101. However, in this case, due to friction resistance, the loss of head of the tube becomes greater, and it is required to use a larger capacity pump to keep the flow rate at a specified level.

On the other hand, with the means shown in FIG. 18, it is possible to increase the quantity of heat exchanged. Namely, a header 105 in the heat-exchange medium inlet side and a header 106 in the heat-exchange medium outlet side are provided, and a plurality of inlet pipes 102 as well as outlet pipes 103 for the heat-exchanger coils 101 are connected respectively to the headers 105 and 106. In this case, however, as clearly understood from the figure, capacity of the body section becomes larger, and the efficiency is not always good. Also, the space required for installation of the heat exchanger becomes inevitably larger.

FIG. 19 is a cross-sectional view illustrating a U-shaped multiple tube heat exchanger. The U-shaped type of heat exchanger comprises a plurality of U-shaped tubes 109 each having a different length respectively in order to fit within the body section 107. Each of the U-shaped tubes 109 is supported within the body section 107 by means of a support metal 110 with edge sections in the inlet and outlet sides fixed on a header fixing plate 108.

One heat-exchange medium flows into the body section 107 from an entrance 111 and flows out from an exit 112. The other heat-exchange medium flows into a header space 114 in the inlet side from an entrance 113, flows through the plurality of U-shaped tubes 109 into a header space 115 in the outlet side, and flows out from the exit 116. The heat exchange takes place as the one medium flows through the U-shaped tubes 109 and transfers heat to the medium in the body section 107.

The U-shaped tube heat exchanger described above provides a large heat transfer area, so it is used as a heat exchanger where a large capacity or a large-scale performance is required, as, for instance, in atomic power generating facilities or the like.

However, in this heat exchanger, because the length of each U-shaped tube 109 is different, the loss of head due to tube friction resistance in each U-shaped tube 109 varies from tube to tube. For this reason, the flow velocity or flow rate of heat-exchange medium flowing in each U-shaped tube 109, cannot be kept at a constant level. As a result, thermal stress generated in each U-shaped tube 109 becomes not uniform, and distortion or cracking easily occurs.

Further, the U-shaped tube 109 has a straight portion and a bending section. Any significant distortion difference between the two sections will often cause breakage.

Finally, the supporting forces at the edge sections of the U-shaped tube 109 where the tubes are fixed on the header fixing plate 108 are different from those in the bending section. Thus, when vibration of the tube occurs, fatigue and cracking can take place, especially at the contact section between the U-shaped tube and the support metal 110.

SUMMARY OF THE INVENTION

An object of the present invention is to provide a heat-exchanger system which has an enhanced heat-exchanging capability without increasing the capacity of the body section, thus making available a larger-scale heat-exchanging performance.

Another object of the present invention is to provide a heat-exchanger coil assembly and a complex thereof in which the heat-exchanging capability is maximized for a preset capacity of the body section.

A further object of the present invention is to provide a heat-exchanger coil assembly having a plurality of heat-exchanger coils in which the flow rate of heat-exchange medium flowing in these coils can be kept at a constant level.

The present invention employs such means as described below in order to achieve the objects as described above.

The present invention provides a heat-exchanger coil assembly having a first header 2, a second header 3 at a preselected separation from the first header, and a plurality of heat-exchanger coils 9 each communicating between the first header and the second header so that the two headers are communicated to each other. The heat-exchanger coils each have a different winding diameter and are grouped in juxtaposition such that each of the heat exchanger coils is respectively surrounded by another heat-exchanger coil having a larger winding diameter.

Also, the present invention provides a heat-exchanger coil assembly, wherein each of the heat-exchanger coils has a substantially equal length.

In one embodiment, the present invention provides a heat-exchanger coil assembly having an inlet tube 4 for introducing a first heat-exchange medium into the body section of a heat-exchanger, an inlet side header 2 provided in the inlet tube, an outlet tube 5 for discharging the heat-exchange medium from the body section, an outlet side header 3 in the outlet tube at a space from the header in the inlet side, a plurality of heat-exchanger coils 9 provided between the inlet side header and the outlet side header so that the two headers are communicated to each other, each such coil having a different winding diameter and a substantially equal length, and wherein the heat-exchanger coils are grouped in juxtaposition such that each of the heat-exchanger coils is respectively surrounded by another heat-exchanger coil having a larger winding diameter.

In a preferred embodiment of the present invention, the inlet tube and the outlet tube extend substantially in parallel to each other, and the inlet side header and the outlet side header are spaced from each other in the axial direction of the inlet tube as well as of the outlet tube and at substantially right angles to the inlet tube and the outlet tube, respectively.

Furthermore, the present invention provides a heat-exchanger coil assembly, wherein both the inlet tube and the outlet tube are provided in a range of winding diameter of the heat-exchanger coil having the minimum winding diameter.

In the heat-exchanger coil assembly of the present invention, it is preferred that the winding diameter of each of the heat-exchanger coils is within a range expressed by the following expression:

$$2D+d \leqq \text{Winding diameter} \leqq (2D+d)\cdot n/1.5$$

wherein D indicates the tube diameter of an inlet tube as well as of an outlet tube; d indicates the tube diameter of a coil, and n indicates the number of turns of a coil having the minimum winding diameter.

In a further embodiment of the present invention, a plurality of heat-exchanger coil assemblies 1*a* and 1*b*, are structured such that the heat-exchanger coil groups 8*a* and 8*b* in each heat-exchanger coil assembly have a common axis, so that the inlet tube 4*a* and the outlet tube 5*a* in each heat-exchanger coil assembly 1*a* extends inside the heat-exchanger coil group 8*b* in all of the heat-exchanger coil assemblies 1*b* provided in one side of the heat-exchanger coil assembly.

DESCRIPTION OF THE PREFERRED EMBODIMENT

The following description of the present invention is made with reference to the related drawings.

Figure 1:
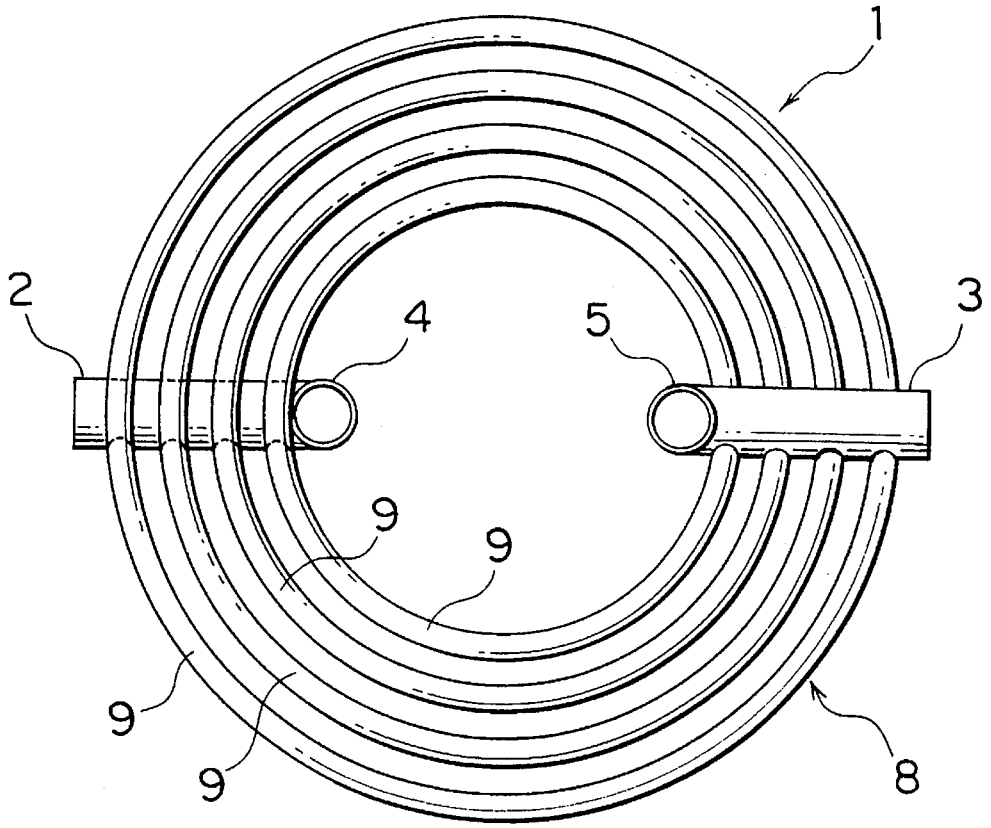
FIG. 1 is a plan view illustrating the first embodiment of the present invention.
Figure 2:
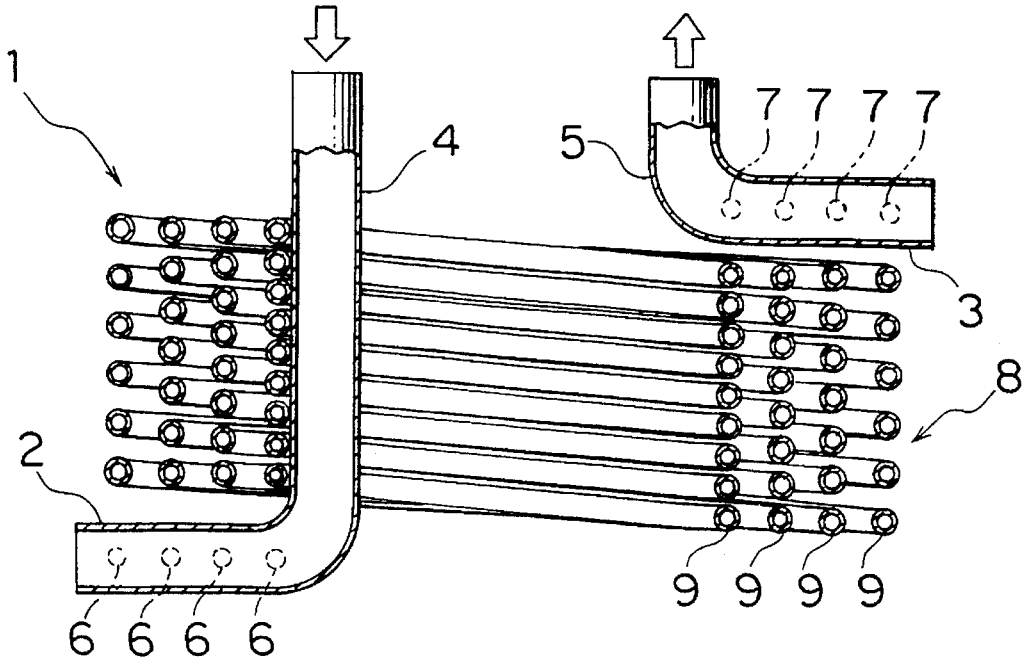
FIG. 2 is a cutaway front view illustrating the same embodiment as described above.

In the heat-exchanger coil assembly in the first embodiment of the present invention shown in FIGS. 1 and 2, the header 2 in the inlet side constituting either of the first header or the second header is provided at right angles to the bottom edge of the inlet tube 4, namely at L-shaped. The header 3 in the outlet side constituting the other side of the first header or the second header is also provided at right angles to the bottom edge of the outlet tube 5, at L-shaped.

The inlet tube 4 and the outlet tube 5 are provided in parallel to each other, and the header 2 in the inlet side and the header 3 in the outlet side are provided at a space from each other in the axial direction of the inlet tube 4 as well as of the outlet tube 5. A plurality of outlet holes 6 are provided on the peripheral wall of the header 2 in the inlet side at a specified space from each other in the axial direction thereof. A number of outlet holes 6 is four in this embodiment. Similarly, on the peripheral wall of the header 3 in the outlet side are the same number of inlet holes 7 as that of the outlet holes provided at a specified space from each other.

The group of heat-exchanger coils 8 is provided between the header 2 in the inlet side and the header 3 in the outlet side. The group of heat-exchanger coils 8 comprises a plurality of circular heat-exchanger coils 9 each having a different winding diameter. Each of the heat-exchanger coils 9 is surrounded by another plurality of heat-exchanger coils 9 having a larger winding diameter. In this embodiment each of the heat-exchanger coils 9 has a common axial line and is provided concentrically.

Also, each of the heat-exchanger coils 9 has a substantially equal length. Consequently, the number of turns of each heat-exchanger coil 9 becomes smaller and smaller as it goes from inside to outside thereof.

The heat-exchanger coil 9 itself is the same type of heat transfer tube as that in the conventional coil type heat exchanger, and is made with a copper tube, a steel tube, a special steel tube, or the like wound in a spiral form.

The top/bottom edges of each heat-exchanger coil 9 are connected to the inlet hole 7 of the header 3 in the outlet side and to the outlet hole 6 of the header 2 in the inlet side respectively. More particularly, the inner heat-exchanger coils 9 are connected to the outlet hole 6 and inlet hole 7 in the base side of the headers 2 and 3, and the outer heat-exchanger coils 9 are connected to the outlet hole 6 and the inlet hole 7 in the top side of the headers 2 and 3. As described above, the header 2 in the inlet side and the header 3 in the outlet side are communicated to each other through the heat-exchanger coil 9.

In this embodiment, both the inlet tube 4 and the outlet tube 5 are located in a range of smaller diameter than the heat-exchanger coil 9 having the minimum winding diameter. Consequently the inlet 4 extends inside the group of heat-exchanger coil 8.

The heat-exchanger coil assembly 1 is provided in the body section of a heat-exchanger not shown in FIGS. 1 and 2 herein. The first heat-exchange medium such as a gas or a liquid is introduced into the body section thereof as a down flow through the inlet tube 4. The heat-exchange medium flows into each of the heat-exchanger coils 9 via the outlet holes 6 of the header 2 in the inlet side, and ascends inside these heat-exchanger coils 9 in a spiral form.

The first heat-exchange medium executes a heat-exchanging with the second heat-exchange medium in the body section through the tube wall mainly during flowing in these heat-exchanger coils 9. The first heat-exchange medium further flows into the header 3 in the outlet side via the inlet hole 7, is discharged to outside of the body section through the outlet tube 5, and is sent to the load.

According to the heat-exchanger coil assembly 1, a heat-exchanger capability is enhanced by means of using a plurality of heat-exchanger coils 9. While each of the heat-exchanger coils 9 is provided so that the coils 9 are surrounded by additional heat-exchanger coils 9 having a larger winding diameter, so that a space for installation thereof occupying in the body section of the heat-exchanger coil assembly 1 is saved. In other words, the heat transfer area can be made larger without making the body capacity larger.

Also, each of the heat-exchanger coils 9 is not in a state of serial multiplex winding, but is wound independently, so that the loss head due to friction resistance of the tube will not become larger.

Also, by increasing or decreasing a number of heat-exchanger coils 9 according to necessity, the heat-exchanger capability can be freely set, and the heat-exchanger coil assembly can be applied to heat exchangers in a range from small-scale to large-scale.

Also, as each of the heat-exchanger coils 9 has a substantially equal length, the loss head of each heat-exchanger coil 9 becomes substantially constant. Consequently, the flow rate of the heat-exchanger medium flowing in each of the heat-exchanger coils 9 becomes uniform, and distortion or cracking due to nonuniform thermal stress generated in some portion of the heat exchanger does not occur. For this reason, heat transfer tubes in the same shape can be used, making processing control easier. Also, the time of coil repairing and that of coil exchanging are substantially the same, thus making coil maintenance easier.

Figure 3:
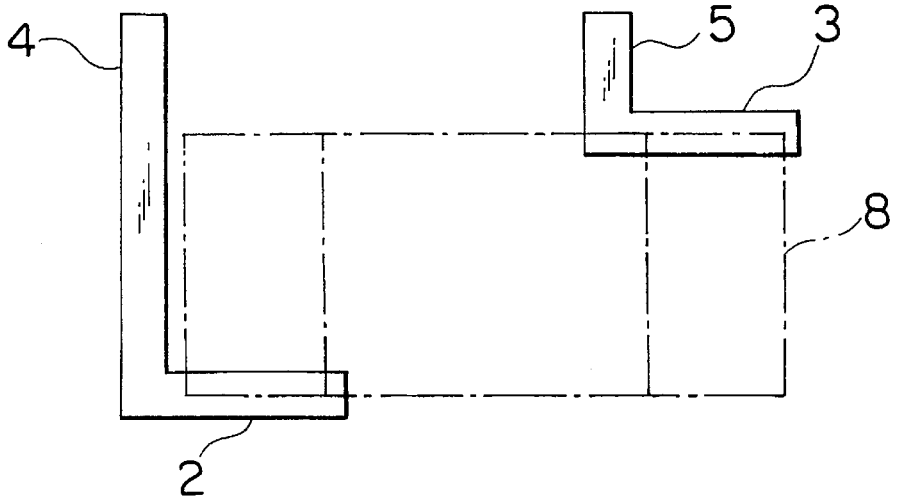
FIG. 3 is a view illustrating the first example of arrangement of an inlet tube and an outlet tube to a group of heat-exchanger coils.
Figure 4:
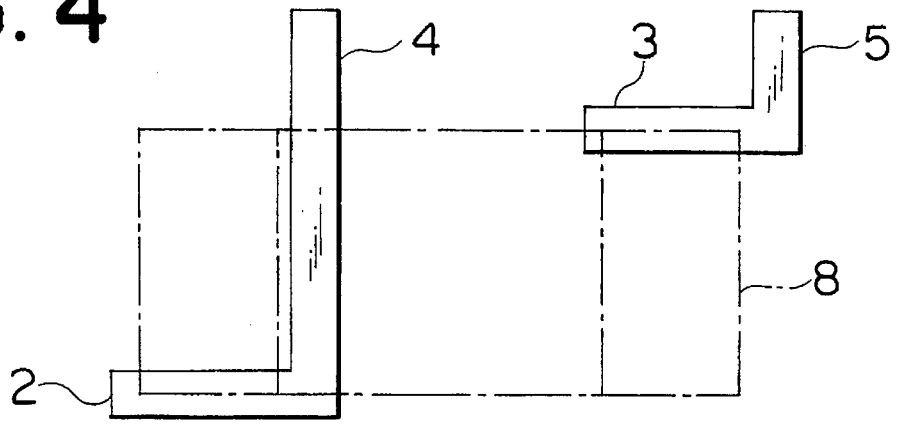
FIG. 4 is a view illustrating the second example thereof.
Figure 5:
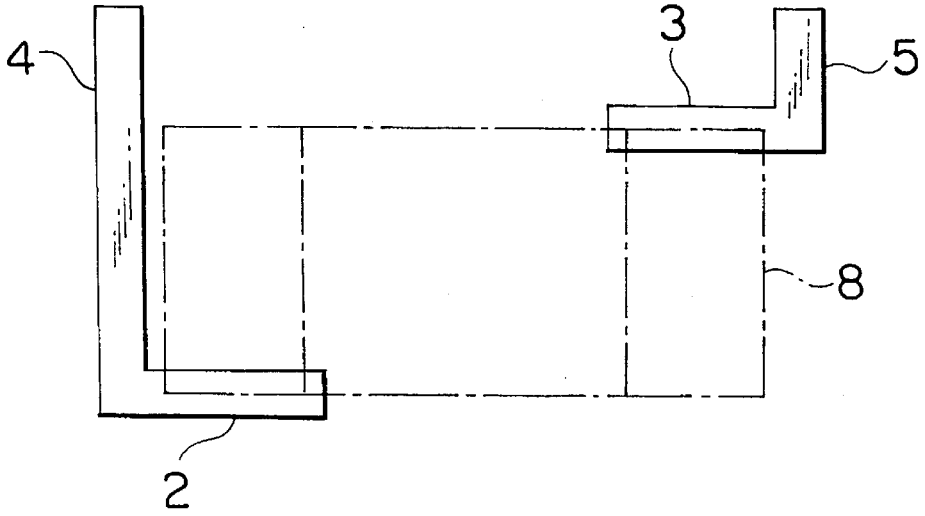
FIG. 5 is a view illustrating the third example thereof.

In FIGS. 3 to 5, the group of heat-exchanger coils 8 is indicated with a chain line for simplification. Shown in FIG. 3 is an example where the inlet tube 4 is provided outside the group of heat-exchanger coils 8 (outside of the heat-exchanger coils 9 having the maximum winding diameter), while the outlet tube 5 is provided inside the group of heat-exchanger coils 8 (inside the heat-exchanger coils 9 having the minimum winding diameter). Shown in FIG. 4 is an example where the inlet tube 4 is provided inside the group of heat-exchanger coils 8, while the outlet tube 5 is provided outside the group of heat-exchanger coils 8. Shown in FIG. 5 is an example where both the inlet tube 4 and the outlet tube 5 each are provided outside the group of heat-exchanger coils 8. As described above, the inlet tube 4 and the outlet tube 5 can be provided in various modes, however, it is clear that the modes shown in FIGS. 1 and 2 are the most compact among them and can provide space-saving for installation thereof.

Figure 6:
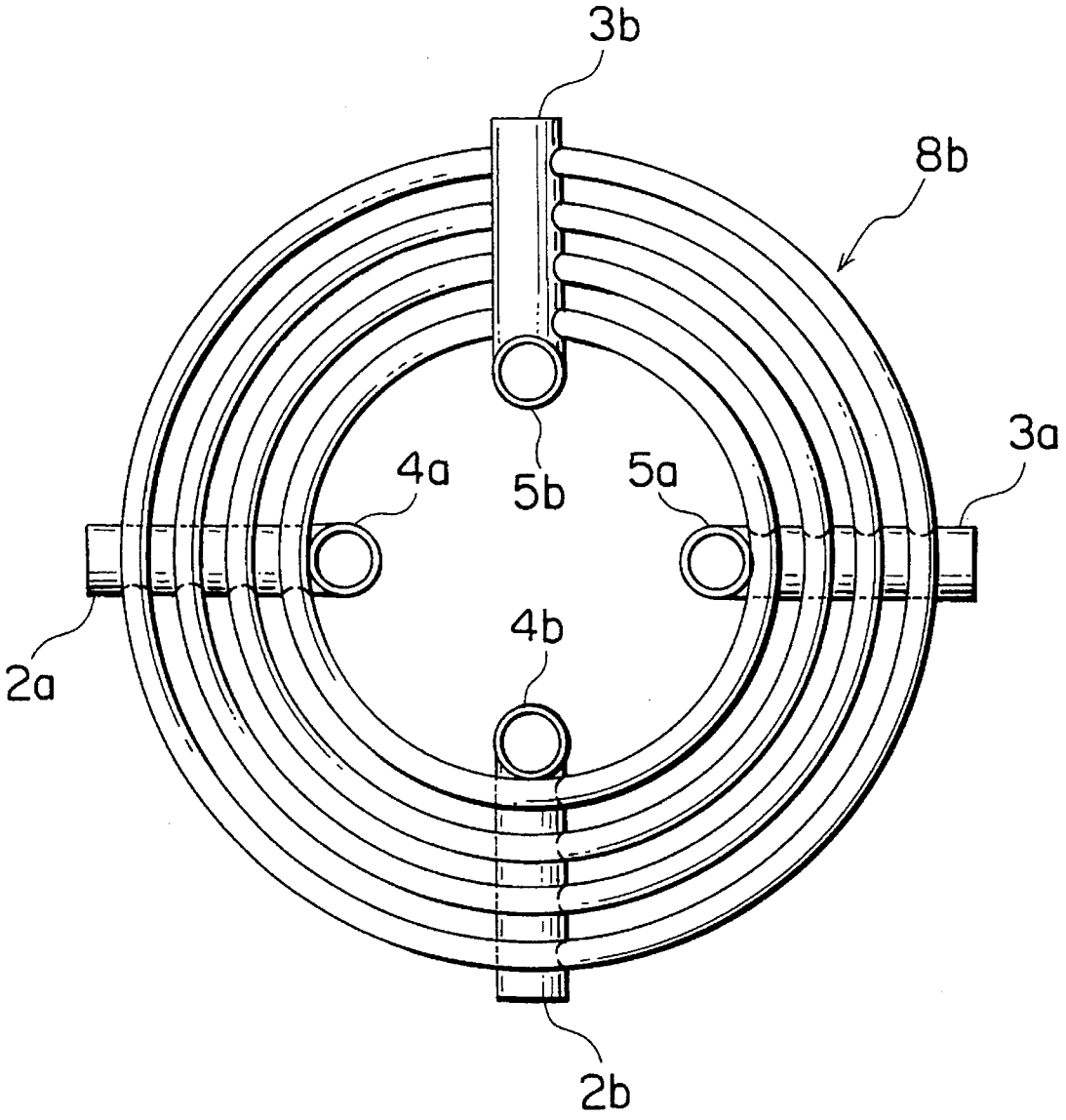
FIG. 6 is a plan view illustrating the second embodiment of the present invention.
Figure 7:
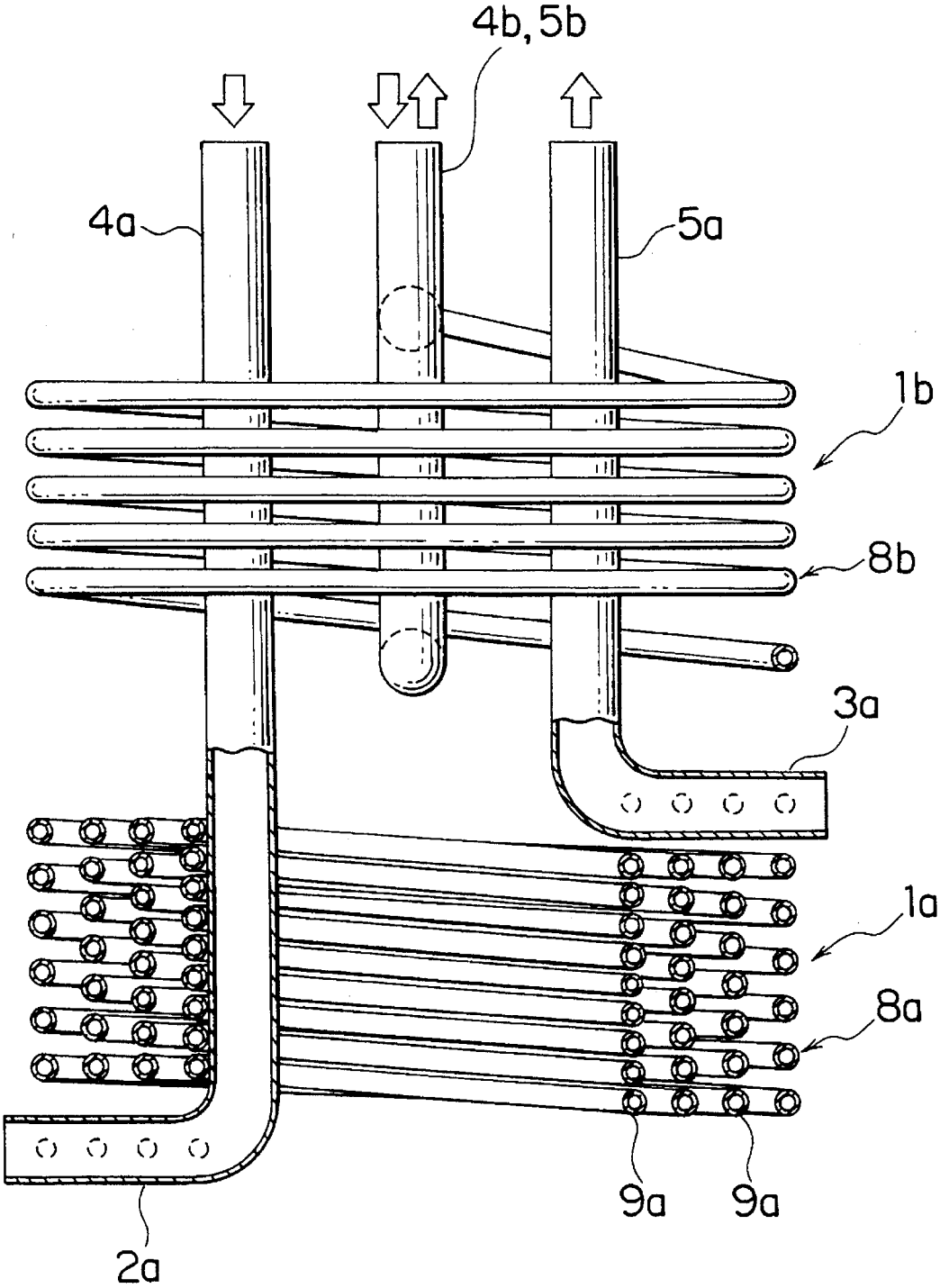
FIG. 7 is a cutaway front view illustrating the same embodiment as described above.

In the second embodiment of the present invention shown in FIGS. 6 and 7, the load is based on two systems and according to this system the heat-exchanger coil assembly becomes a complex comprising two pieces of heat-exchanger coil. The two heat-exchanger coil assemblies 1*a* and 1*b* each have the same configuration as that of the heat-exchanger coil assembly 1 shown in FIGS. 1 and 2.

The two heat-exchanger coil assemblies 1*a* and 1*b* are provided in multiple stages so that these groups of heat-exchanger coils 8*a* and 8*b* have a common axial line. In this embodiment the common axial line extends vertically. Also the inlet tube 4*a* and the outlet tube 5*b* of the heat-exchanger coil assembly 1*a*, provided in the lower side, extend inside the group of heat-exchanger coils 8*b* of the heat-exchanger coil assembly 1*b* provided in the upper side.

In this embodiment two pieces of heat-exchanger coil assembly are used. In the case of three pieces or more, the inlet tube and outlet tube of the heat-exchanger coil assembly in the lower side are provided so that they extend inside the group of heat-exchanger coils of the entire heat-exchanger coil assembly in the upper side.

Figure 8:
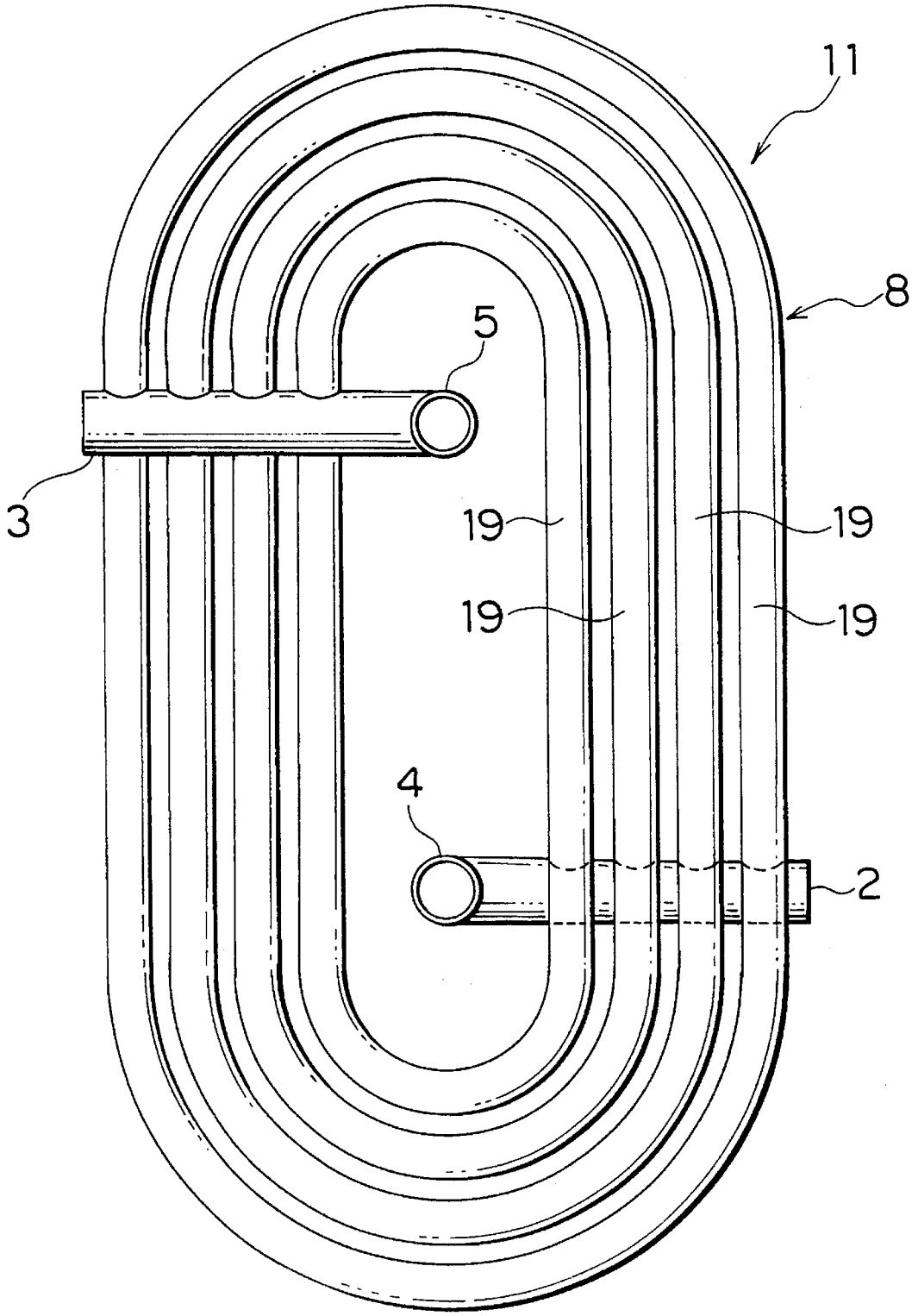
FIG. 8 is a plan view illustrating the third embodiment of the present invention.
Figure 9:
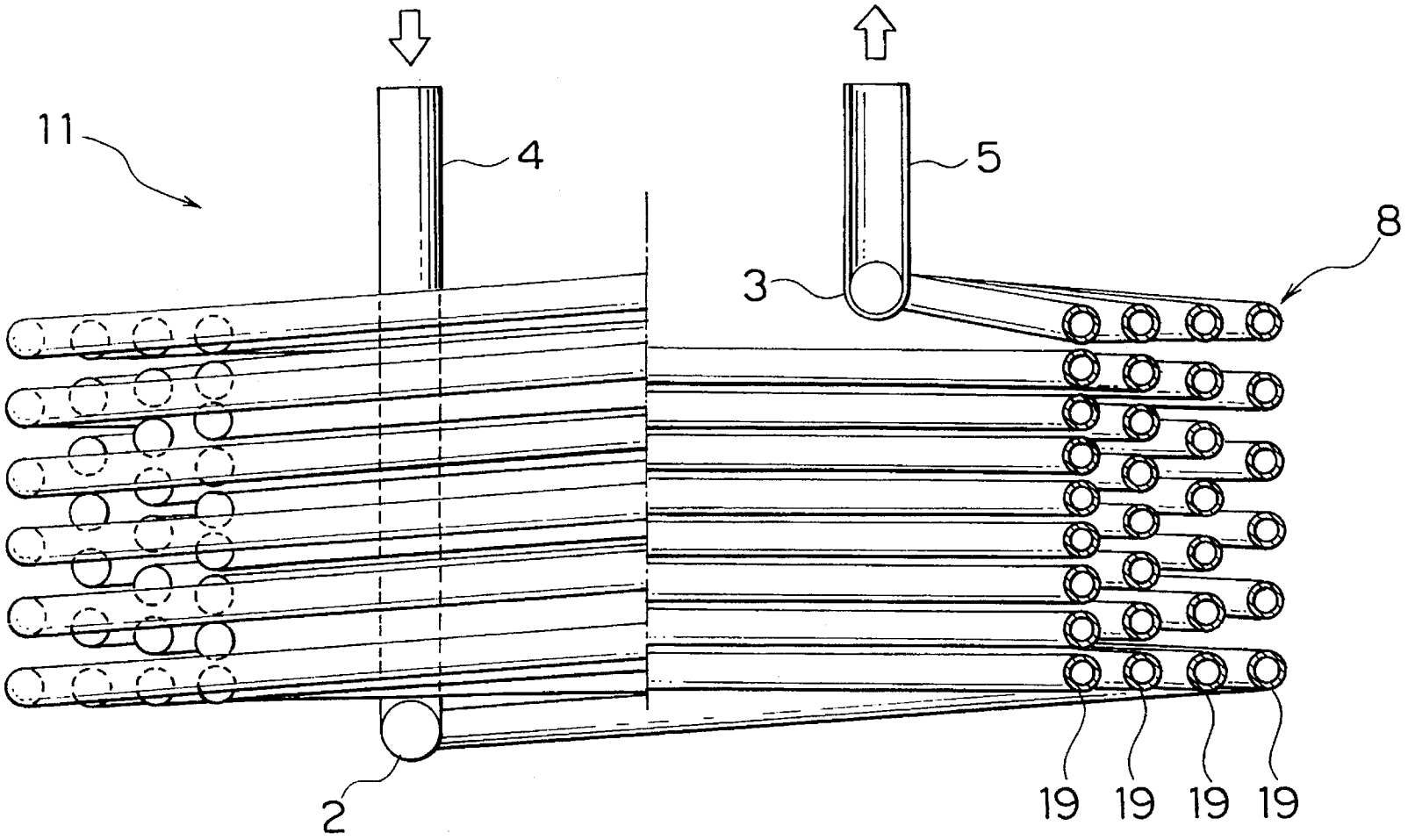
FIG. 9 is a cut away elevation view illustrating the same embodiment as described above.

In FIGS. 8 and 9, the third embodiment of the present invention is shown. Circular heat-exchanger coils are used in each embodiment described above. The heat-exchanger coil assembly 11 in this embodiment incorporates heat-exchanger coils 19 having an oval or a "track" shape. Notwithstanding the shape of the heat-exchanger coil, the configuration herein is the same as that in the embodiment using the circular coils described above.

Figure 10:
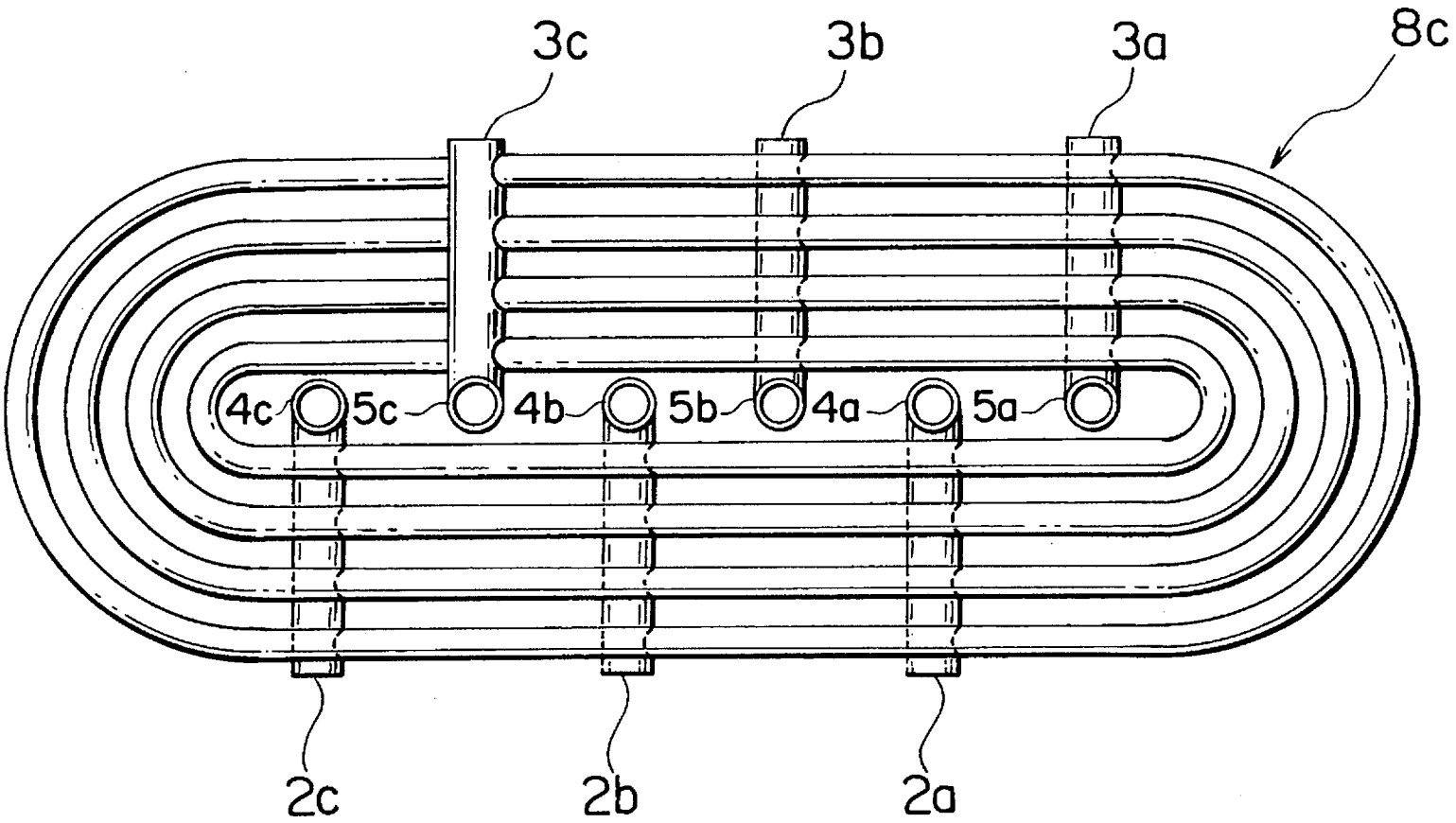
FIG. 10 is a plan view illustrating the fourth embodiment of the present invention.
Figure 11:
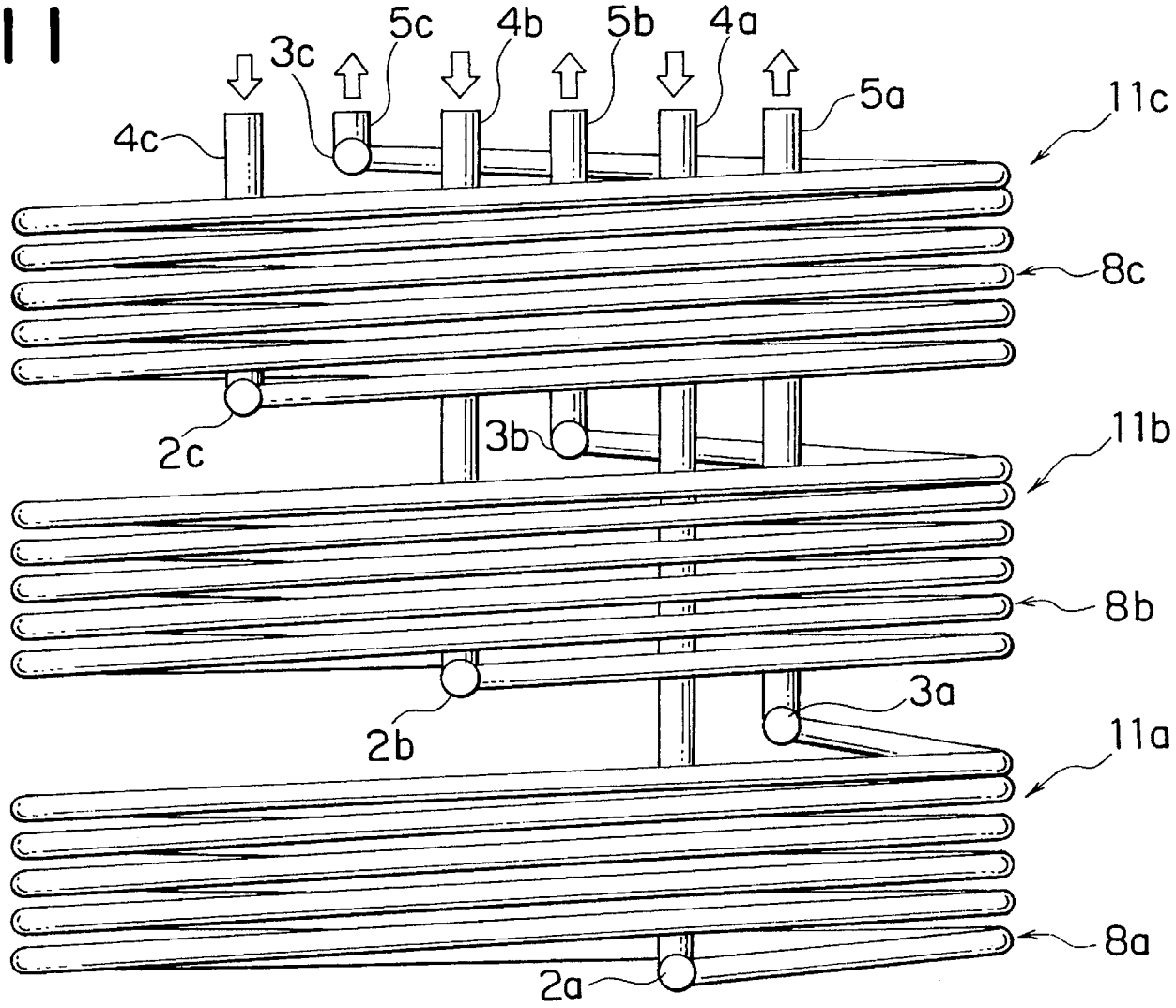
FIG. 11 is a front view illustrating the same embodiment as described above.

The fourth embodiment of the present invention shown in FIGS. 10 and 11 comprises a complex using a plurality of the heat-exchanger coil assemblies like that in embodiment 2, and these groups of heat-exchanger coils 8*a*, 8*b*, and 8*c* are provided in multiple stages so that they have a common axial line. However, in the third embodiment, three heat-exchanger coil assemblies 11*a*, 11*b*, and 11*c* are used in order to correspond to three types of load. Furthermore, the point that the heat-exchanger coil 19 in an oval or track shape is used herein is different from that in the second embodiment.

The three heat-exchanger coil assemblies 11*a*, 11*b*, and 11*c* have the same configuration as that of the heat-exchanger coil assembly 11 shown in FIGS. 8 and 9.

Figure 12:
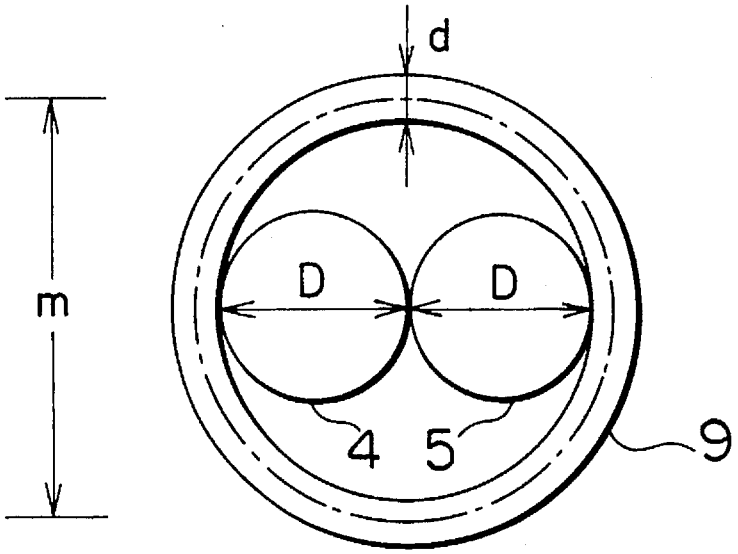
FIG. 12 is a view illustrating a correlation between an inlet tube and an outlet tube and a circular coil.

A correlation between the inlet tube as well as the outlet tube, and the circular coil is shown in FIG. 12, and when the circular coil is used as described above, the minimum winding diameter m of the coil is determined by the following expression (herein D indicates the tube diameter of the inlet tube 4 and the outlet tube 5, d indicates the tube diameter of the coil 9):

$$m=2D+d$$

Also, given a number of the turns of n, the length L of the coil having the minimum winding diameter is determined by the following expression:

$$\begin{aligned} L &= \pi \cdot m \cdot n \\ &= \pi \cdot (2D+d) \cdot n \end{aligned} \tag{1}$$

On the other hand, the length of the coil having the maximum winding diameter is equal to L and a number of the turns thereof is 1.5 (a turn and a half), so that given the maximum winding diameter of the coil of M, the relation above is satisfied with the following expression:

$$L=1.5\pi M \quad (2)$$

With the expressions (1) and (2), the maximum winding diameter of the coil is determined by the following expression:

$$M=(2D+d)\cdot n/1.5$$

Figure 13:
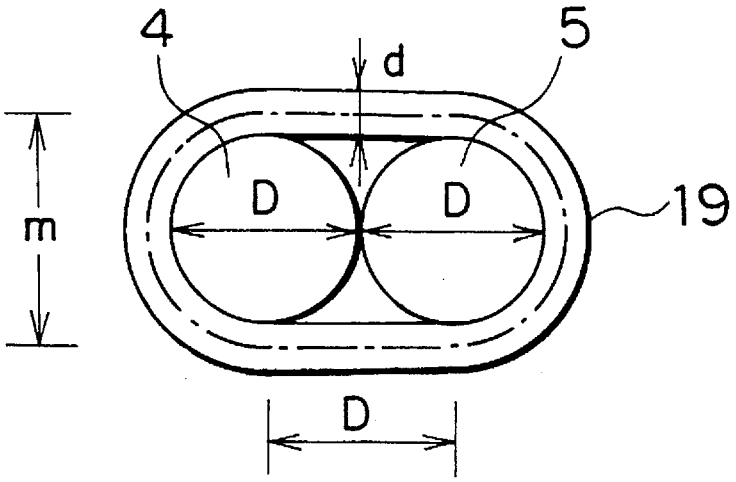
FIG. 13 is a view illustrating a correlation between an inlet tube and an outlet tube and an oval coil.

The correlation between the inlet tube as well as the outlet tube and the coil in an oval shape is shown in FIG. 13, and when the coil in an oval shape or the coil in a track shape is used as described above, the minimum diameter of the coil m is determined by the following expression:

$$m=D+d$$

Also, given a number of the turns of n, the length L of the coil having the minimum winding diameter in consideration of the length D of the straight line is determined by the following expression:

$$\begin{aligned} L &= (\pi \cdot m + 2D) \cdot n \quad (3) \\ &= \{\pi \cdot (D+d) + 2D\} \cdot n \end{aligned}$$

On the other hand, similarly in the case of the circular coil, the length of the coil having the maximum winding diameter is equal to L, and a number of the turns thereof is 1.5, so that given the maximum winding diameter of the coil of M, the relation above is satisfied with the following expression:

$$L=1.5(\pi\cdot M+2D) \quad (4)$$

With the expressions (3) and (4), the maximum winding diameter M of the coil is determined by the following expression:

$$M=(D+d)\cdot n/1.5+(2n-3)\cdot d/1.5\pi$$

Figure 14:
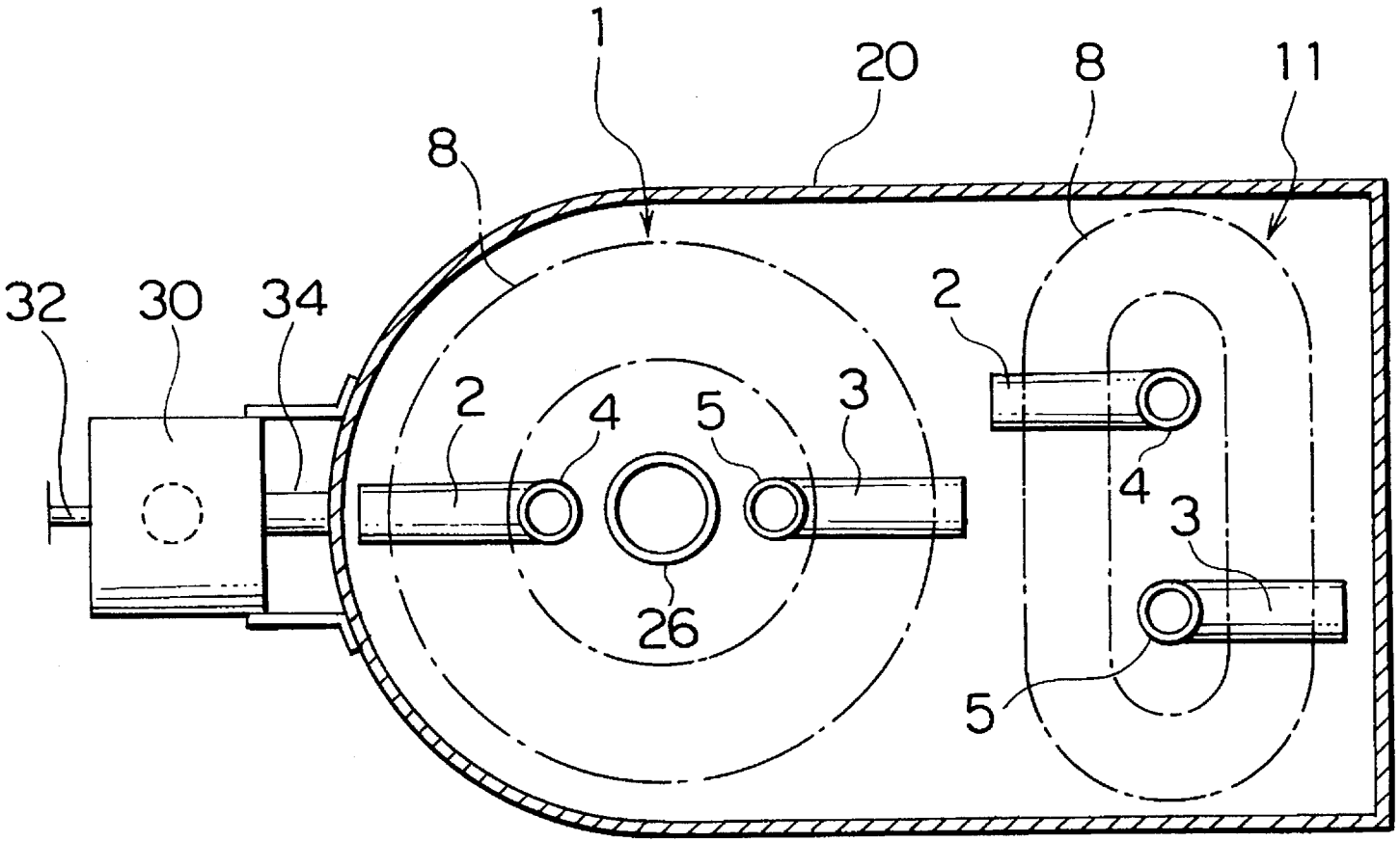
FIG. 14 is a traverse cross section view illustrating a heated water generator which is a heat-exchanger applying a heat-exchanger coil assembly thereto according to the present invention.
Figure 15:
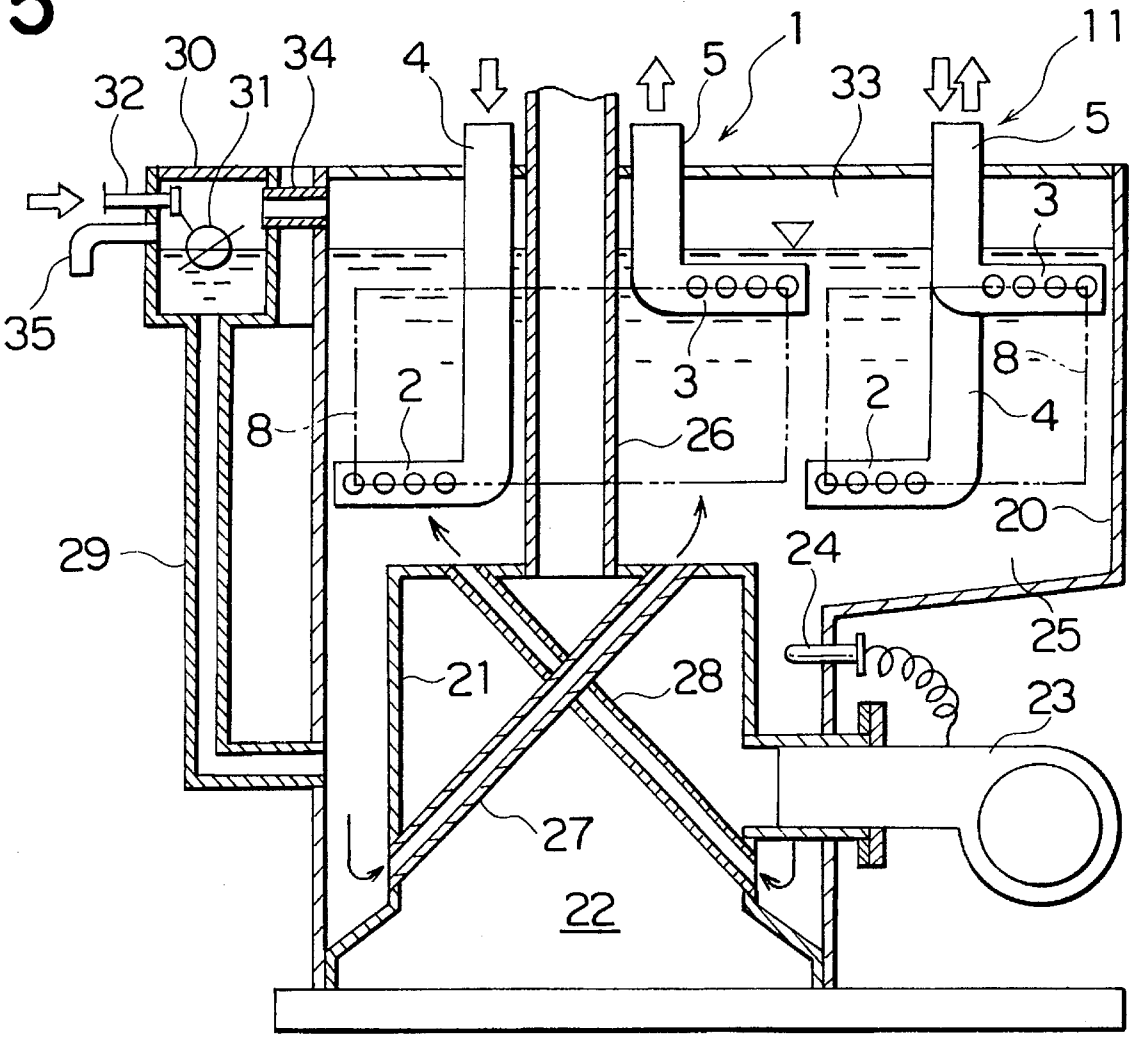
FIG. 15 is a vertical cross section view illustrating the same heated water generator as described above.
Figure 16:
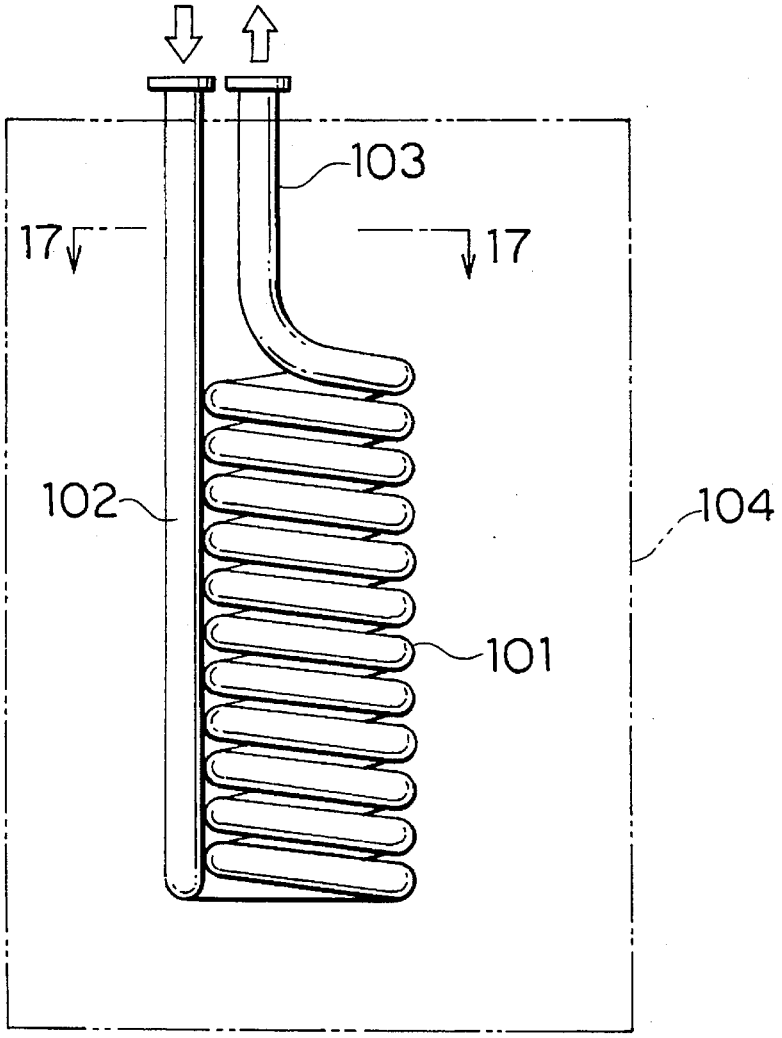
FIG. 16 PRIOR ART
FIG. 16 is a front view illustrating an example of conventional coil type heat exchanger thereof.
Figure 17:
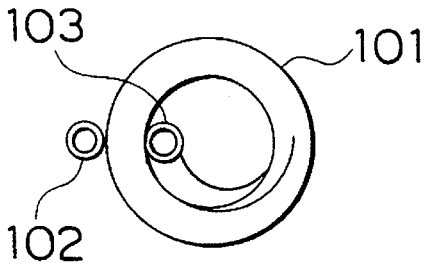
FIG. 17 PRIOR ART
FIG. 17 is a cross section view illustrating a cross section at the line 17—17 in FIG. 16.
Figure 18:
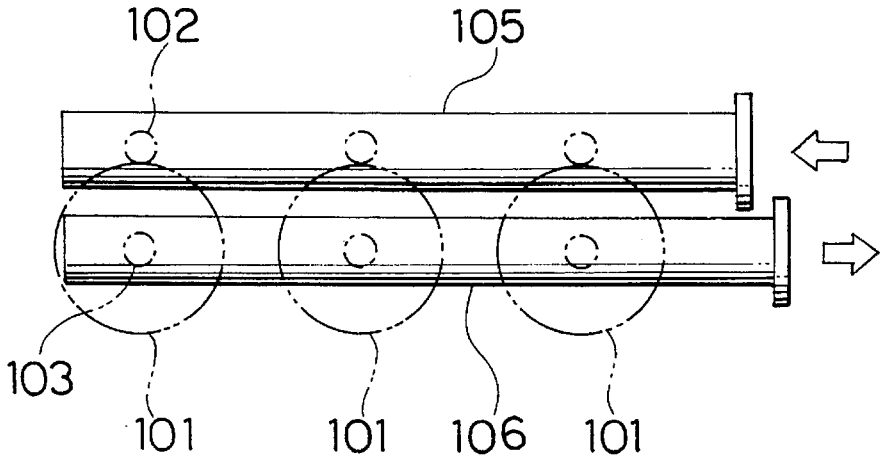
FIG. 18 PRIOR ART
FIG. 18 is a plan view illustrating another example of conventional coil type heat exchanger thereof.
Figure 19:
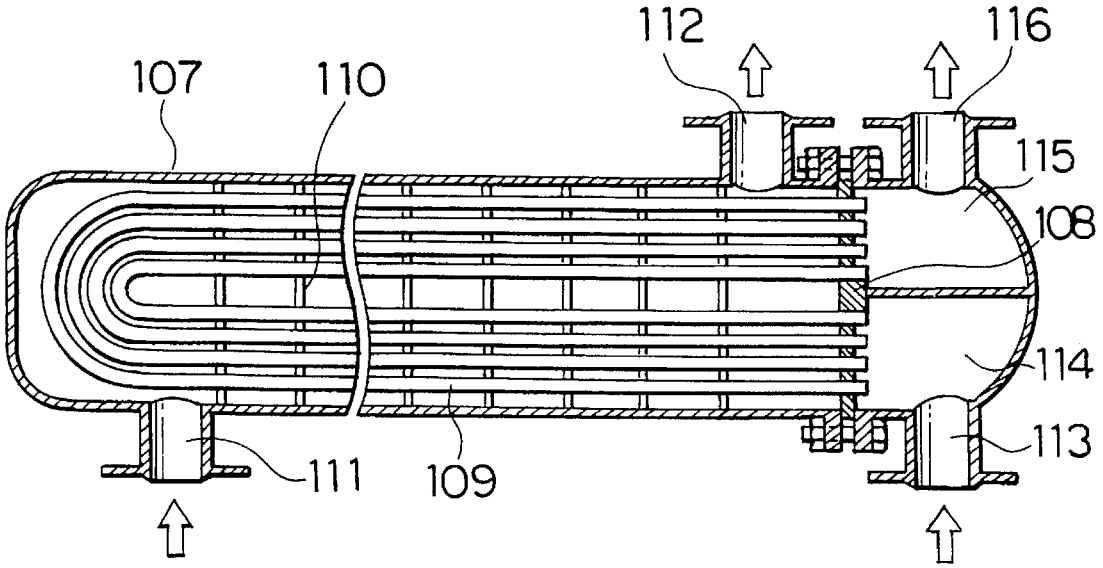
FIG. 19 PRIOR ART
FIG. 19 is a cross section view illustrating a further example of conventional coil type heat exchanger thereof.

In the hot water generator, which is the heat exchanger applying the heat-exchanger coil assembly of the present invention shown in FIGS. 14 and 15, the flue 21 is provided in the bottom of the body section 20, and the furnace room 22 is formed inside the flue. The combustion equipment 23 is opened in the furnace room 22, and operation of the combustion equipment 23 is controlled by the thermostat 24 so that water 25 stored in the body section 20 is kept at the specified temperature.

Flame generated in the combustion equipment 23 becomes high temperature gas in the furnace room 22, and the gas is discharged to the outside via the exhaust pipe 26. During this time, the high temperature gas heats the storage water 25 via the tube wall of the convection tube 27 and the wall of the flue 21.

The body section 20 is communicated to the distilled water tank 30 via the communicated tube 29. The ball tap is provided in the distilled water tank 30, and supply water is supplied from the distilled water tube 32 so that the level of the stored water can be kept at a constant level.

The air chamber 33 is formed above the level in the body section 20, and the air chamber 33 is open to the air via the communicating tube 34, the distilled water tank 30, and the air open tube 35. With this feature, the storage water 25 is heated under the air pressure, so that its temperature does not exceed the boiling point (100° C.) under the air pressure.

Provided in the body section 20 are two heat-exchanger coil assemblies 1 and 11 according to the present invention. One of the heat-exchanger coil assembly 1 comprises circular coils, while the other of the heat-exchanger coil assembly 11 comprises coils in an oval shape or track shape. The two heat-exchanger coil assemblies 1 and 11 each are connected to different load systems respectively. The load systems herein are, for instance, heating circulation systems used to provide heating or hot-water supply in a bath room or in a swimming pool.

The first heat-exchanger medium (normally, a liquid such as water) of the load system is introduced into the body section 20 via the inlet tube 4 of the heat-exchanger coil assemblies 1 and 11. While flowing in each of the heat-exchanger coil assemblies in the groups of heat-exchanger coils 8, the first heat-exchanger medium heat-exchanges with storage water 25, which is the second heat-exchanger medium, is heated thereby, and is sent to the load system via the outlet tube 5.

Notwithstanding the description of the present invention provided above, the present invention is not limited to these embodiments. Various modifications described below are possible as long as the modifications do not depart from the essence of the present invention.

(1) A flow of the heat-exchanger medium in the heat-exchanger coil assembly 1 can be reverse to the embodiments described above. Namely, the tube 5 and the header 3 each can be made to an inlet tube and a header in the inlet side respectively, and the tube 4 and the header 2 can be made to an outlet tube and a header in the outlet side respectively.

(2) A winding shape of the heat-exchanger coils is not limited to a circle or an oval shape, but various types of shapes such as polygons or the like can be applied.

(3) The heat-exchanger coil assembly of the present invention is not limited to the system based on heat-exchanging of liquid to liquid, but can be utilized to such heat-exchanging as gas to gas, or gas to liquid. Also, a heat-exchanger medium flowing in the coils can be any of a heat-receiving medium and a heating medium.

(4) In FIGS. 14 and 15, shown is an example that the heat-exchanger coil assembly of the present invention is applied for a heat-exchanger in a vertical type, but it can be applied for a heat-exchanger in a horizontal type.

In all cases, the preferred heat exchanging medium is water and the assemblies are designed to provide heating to bodies of water. However, as one skilled in this art will appreciate, the assembly of the present invention can use any number of fluid heat-exchanging media and can be used to cool a body of fluid.

As described above, according to the present invention, a heat-exchanging capability can be enhanced without making larger the body capacity of a heat-exchanger. Also, a heat-exchanging capability can be set freely.

We claim:

1. A heat exchanger coil assembly, comprising:

an outlet tube, an inlet tube, and a body section;

said inlet tube having an inlet header substantially perpendicular to said inlet tube;

said outlet tube being oriented substantially parallel to and at a space from said inlet tube and having an outlet header substantially perpendicular to said outlet tube; and said body section comprising a plurality of heat exchanger coils of substantially equal length connecting said inlet header and said outlet header, each of said coils being spirally wound around an axis defined by said tubes and having a different winding diameter and being wound in a manner that the coils collectively define a series of concentric cylinder-like shapes, and wherein the inside diameter of the coil having the smallest winding diameter defines the maximum said space between the inlet tube and the outlet tube.

2. The heat-exchanger coil assembly according to claim 1, wherein a winding diameter of each of said heat-exchanger coils is within a range expressed by the following expression:

$$2D+d \leqq \text{Winding diameter} \leqq (2D+d)\cdot n/1.5$$

Wherein D indicates the tube diameter of an inlet tube as well as of an outlet tube; d indicates the tube diameter of a coil, and n indicates the number of turns of the coil having the minimum winding diameter.

3. A complex comprising a plurality of the heat-exchanger coil assemblies of claim 1, said assemblies arranged so as to have a common axial line, and wherein the inlet tube and the outlet tube in each heat-exchanger coil assembly extends inside each heat-exchanger coil assembly to one end of the complex.

* * * * *